US006691589B2

(12) United States Patent
Gillman et al.

(10) Patent No.: US 6,691,589 B2
(45) Date of Patent: Feb. 17, 2004

(54) SWITCH HANDLE

(75) Inventors: Uwe Gillman, Berlin (DE); Rainer Maurer, Berlin (DE); Stoffers Michael, Berlin (DE); Lamm Klaus, Berlin (DE); Jost Hans-Georg, Mahlow (DE)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 74 days.

(21) Appl. No.: 10/164,167

(22) Filed: Jun. 5, 2002

(65) Prior Publication Data

US 2002/0184735 A1 Dec. 12, 2002

(30) Foreign Application Priority Data

Jun. 6, 2001 (DE) ..... 101 27 515

(51) Int. Cl.[7] ..... G05G 13/00
(52) U.S. Cl. ..... 74/471 XY; 248/118.3
(58) Field of Search ..... 74/471 XY; 248/118, 248/118.3, 124.1, 145.6

(56) References Cited

U.S. PATENT DOCUMENTS 4,531,080 A * 7/1985 Nordstrom et al. ..... 318/628
4,997,054 A * 3/1991 Denny et al. ..... 180/331
5,158,256 A * 10/1992 Gross ..... 248/118.3
5,907,975 A * 6/1999 Giaimo ..... 74/473.34
6,394,406 B1 * 5/2002 Margo ..... 248/441.1
6,484,829 B1 * 11/2002 Cox ..... 180/8.1
2001/0035479 * 11/2001 Roebuck ..... 248/125.1

* cited by examiner

*Primary Examiner*—David Fenstermacher
(74) *Attorney, Agent, or Firm*—Roger C. Turner

(57) ABSTRACT

A control handle (10) for operating a machine, includes a largely vertical shaft (12) that can be grasped by a person's hand and a hand rest assembly (20) that supports a lower end of the hand opposite the thumb. The hand rest assembly is slidable along the shaft and includes a clamp that clamps against the shaft to fix the position of the hand rest assembly at substantially continuously variable positions along the shaft. The hand rest assembly has front and rear sections (26, 27) that are pivotally connected together, with the rear section being pivotable between a clamping position (27) wherein it draws the front section firmly against the front of the shaft to fix the hand rest position, and a release position (27A) wherein it allows the hand rest assembly to slide to a desired position. The shaft has recesses (36) on laterally opposite sides, that form vertically-extending fixing edges (41) that face largely rearwardly. The rear section forms a pair of clamping surface parts (34) that each clamps against one of the fixing edges as the rear section pivots to the clamp position.

14 Claims, 4 Drawing Sheets

SWITCH HANDLE

BACKGROUND OF THE INVENTION

Control, or switch handles are commonly used to control machinery such as construction and agricultural machinery. Such control handle includes a largely vertical shaft that can be grasped by a person's hand, and a switch apparatus lying at the upper end of the shaft and having switches that can operated by at least one finger of the hand, such as the thumb. A hand rest is mounted at a bottom portion of the shaft to support the operator's hand, as by supporting a side of the hand opposite the thumb.

Operators are most comfortable with the hand rest at a selected distance from the switch assembly, depending upon the size of the operator's hand and the way in which he/she places his hand around the shaft. Control handles currently on the market are adjustable between three positions by pulling a pin out of one of three holes in a bottom part of the shaft, sliding the hand rest, and reinserting the pin. Such mechanism allows adjustment only between a limited number of spaced positions, and the operator's hand may be comfortable only when the hand rest is between two of those positions. Also, adjustment requires manipulation from below the hand rest surface, which is often awkward especially when there is a wall close below the hand rest. The provision of holes also has the disadvantage of weakening the bottom part of the shaft. A hand rest for a control handle, which enabled rapid adjustment to any desire position within a given range, in a simple manner and with a minimum number of parts and with parts that cannot become lost, would be of value.

SUMMARY OF THE INVENTION

In accordance with one embodiment of the present invention, a control, or switch handle is provided for operating a machine, of a type which has a largely vertically elongated shaft, a switch apparatus at an upper end of the shaft, and a hand rest assembly at a lower portion of the shaft, wherein the hand rest assembly can be adjusted to a position suitable for almost any given worker, and can be adjusted without requiring operation in a confined area below the hand rest, and with a minimum number of separate custom parts. The hand rest assembly includes a clamp that clamps against the shaft to fix the position of the hand rest at substantially continuously variable positions along the shaft. Such clamping is accomplished by dividing the hand rest assembly into front and rear sections that are pivotally connected together. The rear section can be pivoted between a clamping position wherein it draws a location on the front section firmly against the shaft, and a release position wherein the second section allows the front section location to separate slightly from the shaft so the hand rest sections can slide along the shaft.

In one arrangement, the shaft is formed with a recess in each of its two laterally opposite sides, each recess forming a largely rearwardly-facing and primarily vertically-extending fixing edge. The rear section of the hand rest assembly forms a pair of clamping surface parts that each clamps against a corresponding one of the fixing edges as the rear section pivots from the release position to the clamp position. In the clamp position, the rear section forms a portion of the surface that can support a portion of the operator's hand.

The novel features of the invention are set forth with particularity in the appended claims. The invention will be best understood from the following description when read in conjunction with the accompanying drawings.

DESCRIPTION OF THE PREFERRED EMBODIMENTS

Figures 1, 2A, 2B:
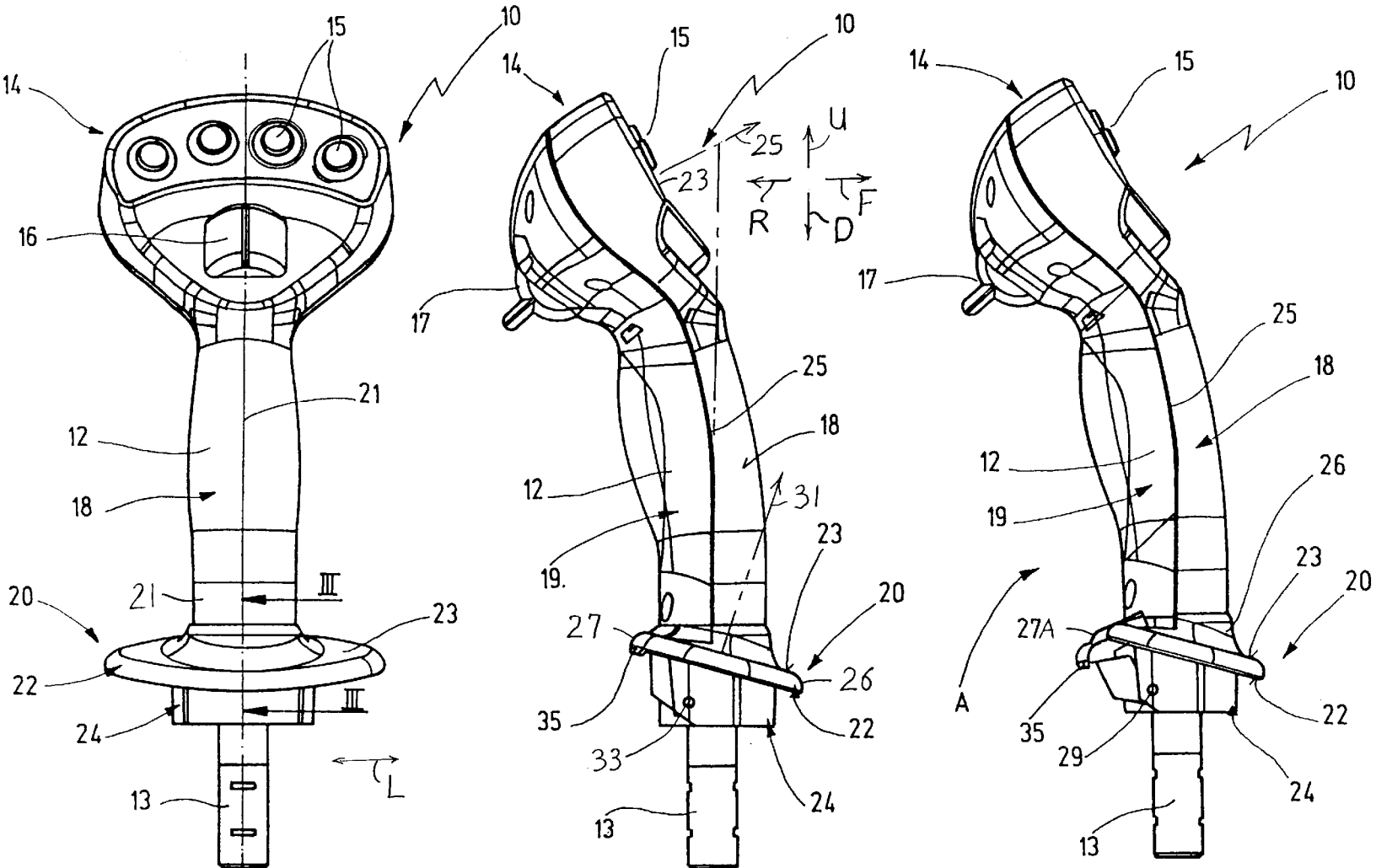
FIG. 1 is a front elevation view of a control handle of one embodiment of the invention.
FIG. 2A is a left side view of the control handle of FIG. 1, in the clamp condition of the hand rest assembly.
FIG. 2B is a view similar to FIG. 2A, but with the hand rest assembly in a release position.

FIG. 1 illustrates a switch handle, or control handle 10 of a type used to control machines such as construction and agricultural machines. The control handle includes a largely vertically-elongated shaft 12, and a switch apparatus 14 at the top of the shaft. A hand rest assembly 20 lies at a lower portion 21 of the shaft. A hollow rod 13 has its upper end fixed in the shaft and has a lower end mounted on the machine. The switch apparatus 14 at the top of the shaft includes switch units 15, 16 and 17 with switch unit 17 best shown in FIGS. 2A and 2B.

The receiver 14 has a forward surface or face 23 that faces in a forward-upward direction 25 which is angled about 30° (15° to 45°) from the horizontal. Forward F and rearward R horizontal directions are shown in FIG. 2A, as are upward U and downward D directions.

The operator can grasp the shaft 12 and operate the switch units 15, 16 with his fingers, and particularly with his thumb, and can operate the switch unit 17 with another finger such as the fore finger. The hand rest assembly supports the side of the hand which is opposite the thumb and which is lowermost when the handle is grasped.

The shaft 12 is formed by front and rear shell halves 18, 20 that respectively form the front and rear of the shaft. The shell halves can be molded from tough engineering plastic material, and are joined together at a parting line 25. The parting line is substantially vertical below the middle of the shaft 12, and extends at an upward and rearward incline of about 15° to the vertical above the middle to the bottom of the switch apparatus. The shell halves 18, 19 also form the housing of the receiver 14 which supports the switch units 15–17. The control handle is symmetric about a center plane 21 (FIG. 1).

The hand rest assembly 20 shown in FIG. 2A includes a largely upwardly-facing support surface 23. In actuality, the support surface 23 faces in a direction 31, at an upward and forward incline of about 20° to the vertical. The hand rest assembly includes front and rear sections 26, 27 that are pivotally connected together at a laterally-extending pivot axis 33. The rear section 27 can be pivoted from the clamp position 27 of FIG. 2A wherein the rear section holds the hand rest assembly 20 at a fixed position on the shaft, to a release position shown at 27A in FIG. 2B, wherein the hand rest assembly can be shifted up or down within a range on the order of one inch.

Figure 4A:
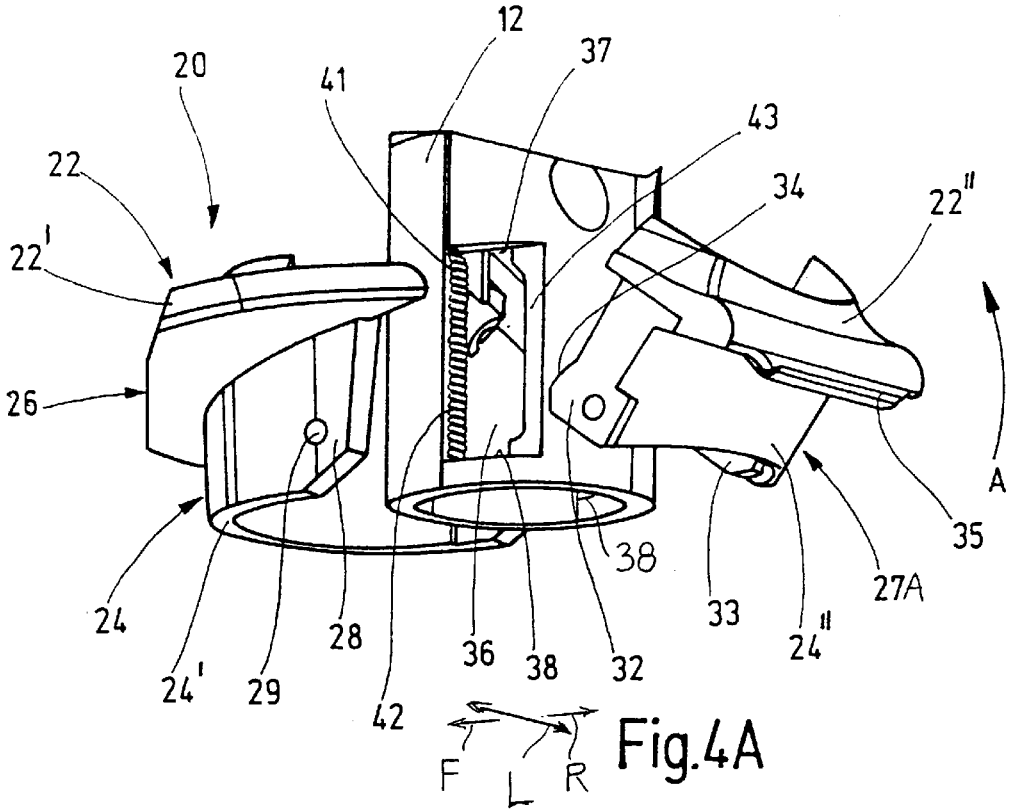
FIG. 4A is an exploded partial rear isometric view of the hand rest assembly and a lower portion of the shaft of FIG. 1.
Figure 4B:
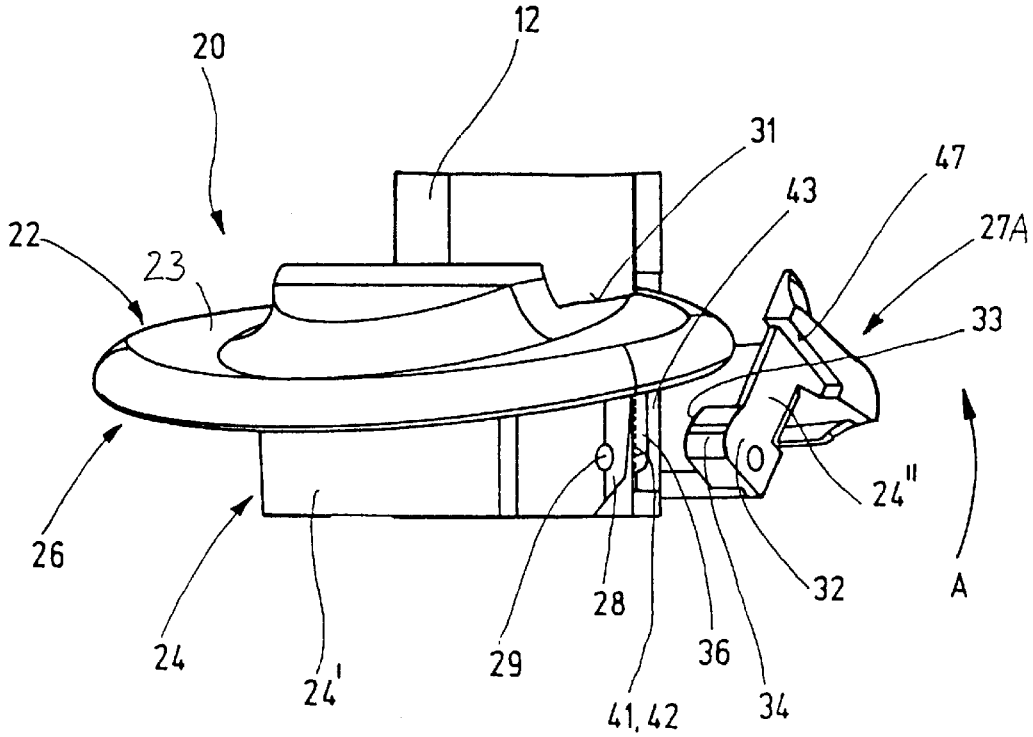
FIG. 4B is a view similar to FIG. 4A, but shown from a partially front view.

FIGS. 4A and 4B show details of the hand rest assembly 20. The hand rest assembly 20 includes a hand support surface 23 that is of largely elliptical shape, with the front portion projecting further forward of the shaft than the rear portion projects rearward of the shaft. If a person is right handed, the bottom of his hand usually will rest on the front portion, on the right side, while if a person is left handed his hand usually will rest on the front portion on the left side thereof.

FIG. 4A shows that the front and rear sections 26, 27A have side flanges 28, 32 that overlap. Pivot pins 29 at laterally L opposite sides of the sections pivotally connect the flanges on the front and rear sections. When moving between the clamp and release positions, only the rear section 27 pivots, while the front section 26 remains with its cylindrical inside surface, which surrounds about 180° of a shaft, lying closely facewise adjacent to the shaft. The hand rest assembly forms a guide sleeve 24 with a front part 24' formed on the front section and with a rear part 24" formed on the rear section. The hand rest assembly also forms a support plate 22 that includes parts 22', 22" of each of the sections, and that forms the support surface. When the rear section pivots inner flange surfaces 33 slide closely across surfaces 43 on the shaft recesses.

As shown in FIG. 4A, the shaft has laterally opposite sides and has a recess 36 in each side. Each recess has upper and lower ends 37, 38. Each recess forms a rear surface 43 and forms a largely rearwardly-facing and primarily vertical-extending fixing edge 41. The rear section 27A has a clamping surface or cam at 34 that moves against the fixing edge 41 when the rear section is pivoted upward to its clamp position. The fixing edge 41 is preferably formed with multiple (at least seven) teeth 42 to more rigidly fix the clamping surface 34 to the fixing edge 41 when the rear section 27A is pivoted up. It is noted that there are recesses 36 at laterally opposite sides of the shaft 12, and there are a pair of flanges 28, 32 at opposite sides of the sections, with each pair of flanges pivotally connected by a pin 29.

Figure 3:
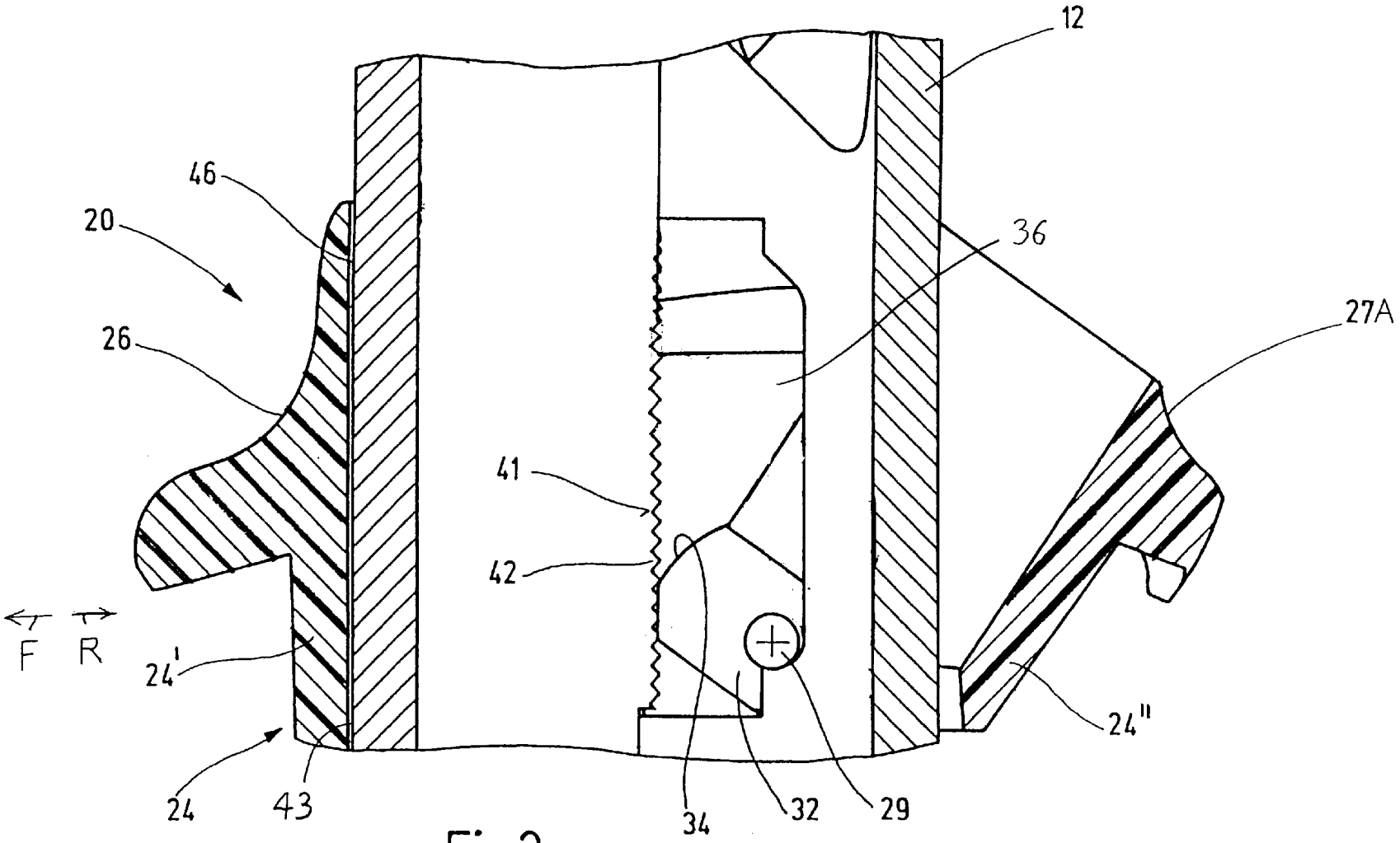
FIG. 3 is an enlarged view taken on line III—III of FIG. 1, and with the hand rest assembly in the release position.

FIG. 3 shows the rear section 27A in its release position, with the clamping surface or cam 34 in position to clamp to the fixing edge 41. When the rear section 27A is pivoted upward, the clamping surface 34 presses firmly against the fixing edge 41. Due to the pivotable connection of the rear section through the pin 29 to the front section 26, this causes the front section 26 to press rearwardly R with considerable force against the front surface 43 of the shaft 12, thereby fixing the hand rest assembly 20 at the chosen clamp position against the shaft.

FIG. 4A shows that the rear section is provided with a ribbed handle 35 that facilitates upward pivoting of the rear section to the clamp position. A considerable downward force against the location 22" on the rear section is required to pivot down the rear section 27 (opposite to the direction of arrow A) to release the hand rest assembly. As mentioned above, the operator usually rests his hand against the top surface of the front section. Even so, a force (e.g. 4 kg) which is greater than the weight applied by the hand to the hand rest during operation of the switch units, is required to pivot the rear section downward to its release position.

The application of forces by the rear section to fixing edges 41 (FIG. 4A) at laterally opposite sides of the shaft, distributes the clamping force by which the front section is pressed against the cylindrical front side of the shaft, and by which the rear section presses against shoulders formed by the fixing edges. The design of FIGS. 1–4 require only two custom parts, these being the front and rear sections 26, 27 to form the hand rest assembly with its clamping capability. The two additional pins 29 are also required to pivotally connect the front and rear sections unless a single pin is used.

Figure 5:
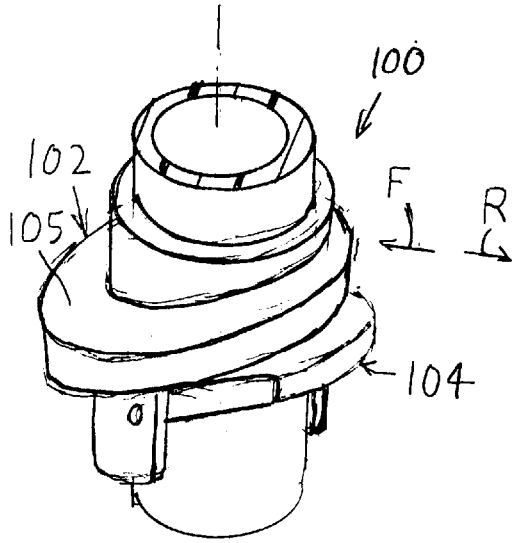
FIG. 5 is a partial isometric view of a control handle of another embodiment of the invention.
Figure 6:
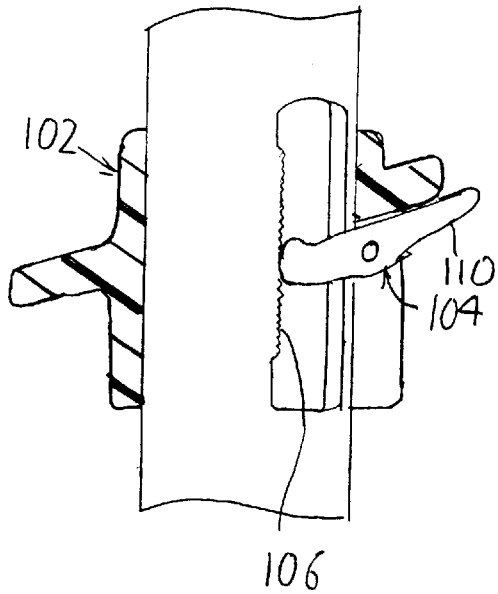
FIG. 6 is a sectional view of the handle of FIG. 5.

FIGS. 5 and 6 illustrate another arrangement, wherein a hand rest assembly 100 includes a first or front section 102 that surrounds most of the shaft and that forms a largely upwardly facing support surface 105 that extends around the entire shaft. A separate clamp 104 that can pivot, can press against vertically extending surfaces 106 at laterally opposite sides of the shaft. The clamp includes a handle 110 that can be lowered to release the hand rest assembly to slide to a new position. The handle 110 can be raised to clamp the assembly at a chosen position.

Thus, the invention provides a control handle of a type useful for operating a machine, which includes a largely vertical shaft with a switch apparatus at the upper end of the shaft and with a hand rest assembly at a lower portion of the shaft, wherein the hand rest assembly is adjustable in height. The hand rest assembly includes a clamp that clamps against the shaft to fix the position of the hand rest support surface at substantially continuously variable positions along the height of the shaft. The assembly includes first and second or front and rear sections that are pivotally connected together. The second section is pivotable between a clamping position wherein it presses against the shaft to draw the first section firmly against the shaft, and a release position. The shaft has laterally opposite sides with a recess in each side, and with each recess forming a largely rearwardly-facing and primarily vertical-extending fixing edge. The rear section forms a pair of clamping parts that each clamps against one of the fixing edges. The fixing edges preferably have teeth. The front and rear sections are pivotably connected by one or two pins. While the switching apparatus at the top of the shaft faces at an upward and forward incline, the hand rest assembly has an upper support surface which supports the hand of the operator, with the support surface facing at an upward and forward incline.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A control handle for operating a machine, which includes a largely vertically elongated shaft for holding by a person's hand, a switch apparatus at an upper end of the shaft for operation by at least one finger of the hand, and a hand rest assembly with a support surface part for supporting a side of the hand opposite the thumb, wherein:

said hand rest assembly is slidable along said shaft, and includes a clamp that clamps against said shaft to fix the position of the support surface part at substantially continuously variable positions along said shaft.

2. The control handle described in claim 1 wherein:

said hand rest assembly includes first and second sections that forms said support surface part and that are pivotally connected together, said second section forming said clamp and being pivotable between a clamping position wherein said second section draws a location on said first section firmly against said shaft, and a release position wherein said second section allows said location on said first section to separate slightly from said shaft to slide therealong.

3. The control handle described in claim 1 wherein:

said shaft has front and rear sides and said switch apparatus faces largely in a front direction;

said hand rest assembly includes a front section that is vertically slideable along the shaft, and a rear section that forms said clamp and that is pivotally connected to the front section about a largely horizontal axis to pivot between release and clamping positions, said rear section forming a clamping surface that clamps against said shaft and that draws said front section against said shaft in said clamping position.

4. The control handle described in claim 3 wherein:

said shaft has laterally opposite sides and has a recess in each side, each recess forming a largely rearwardly-facing and primarily vertically-extending fixing edge, said rear section forming a pair of clamping surface parts that each clamps against a corresponding ones of said fixing edges as said rear section pivots from said release position to said clamping position.

5. The control handle described in claim 4 wherein:

said fixing edges form vertically spaced teeth.

6. The control handle described in claim 2 wherein:

said shaft has laterally opposite sides and has a recess at each of said sides;

said second section is a rear section that has laterally opposite rear side walls that project forwardly and that have pin receiving holes, said first section is a front section that has laterally opposite front side walls that project rearwardly and that have pin receiving holes and that overlap with said rear side walls;

at least one pin that projects through corresponding ones of said pin receiving holes to pivotally connect said side walls of said front and rear sections.

7. The control handle described in claim 2 wherein:

said second section is a rear section that has a rear end that moves up and down as said rear section moves respectively to said clamping and release positions, whereby to enable release of the hand rest assembly by pressing down forcefully against the rear section.

8. The control handle described in claim 1 wherein:

said support surface part has an upper hand-support surface for supporting the lower end of the hand, said hand-support surface tilted from the horizontal when a shaft lower portion extends vertically, so the hand-support surface faces at a forward and upward incline.

9. A control handle, comprising:

a largely vertically-extending shaft for grasping by a person's hand;

a switch assembly mounted at an upper end of said shaft;

a hand rest assembly lying at a lower portion of said shaft, said hand rest assembly including first and second sections lying on opposite sides of said shaft and coupled together, said second section being pivotable against said shaft to press thereagainst and resist sliding of said hand rest assembly along said shaft.

10. The control handle described in claim 9 wherein:

said shaft has a front, a rear, and laterally opposite sides;

said first section extends around said shaft front and has laterally opposite first sections sides;

said second section extends largely around said shaft rear and has second sections sides that are each pivotally connected to a corresponding one of said first section sides;

said second section is pivotable between a clamping position and a release position, said second section forming a cam surface that presses against said shaft when said second section is in said clamping position, to press said first section firmly against said shaft.

11. The control handle described in claim 9 wherein:

said shaft has laterally opposite sides and forms a pair of largely rearwardly-facing shoulders at said laterally opposite sides, and said second section forms two laterally-spaced cams that are each pivotable against one of said shoulders.

12. The control handle described in claim 9 wherein:

said shaft has laterally opposite sides and has a recess in each of said laterally opposite sides, said recesses each forming a largely vertically-extending fixing surface, said second section having laterally opposite clamping surfaces that each clamp against a corresponding one of said fixing surfaces.

13. The control handle described in claim 12 wherein:

each of said recesses forms a guide surface at the rear of the recess, said guide surfaces facing laterally away from one another, and said second section has flanges that slide against said guide surfaces.

14. A control handle which includes a largely vertical shaft and a switch apparatus at an upper end of the shaft, comprising hand rest assembly means which includes first and second sections that surround a lower portion of said shaft and that are pivotally connected about a horizontal axis, said second section having clamping means for clamping against said shaft.

* * * * *